US005562438A

United States Patent [19]

Gordon et al.

[11] Patent Number: 5,562,438

[45] Date of Patent: Oct. 8, 1996

[54] FLUE GAS RECIRCULATION BURNER PROVIDING LOW $NO_X$ EMISSIONS

[75] Inventors: Michael W. Gordon, Manheim; Mikhail Zlatkin, Lancaster; Scott R. Miller, York, all of Pa.

[73] Assignee: Burnham Properties Corporation, Wilmington, Del.

[21] Appl. No.: 493,676

[22] Filed: Jun. 22, 1995

[51] Int. Cl.[6] ..... F23L 1/00

[52] U.S. Cl. ..... 431/115; 431/116; 431/5; 431/2; 431/9

[58] Field of Search ..... 431/115, 5, 2, 431/9, 116

[56] References Cited

U.S. PATENT DOCUMENTS 4,488,869 12/1984 Voorheis .
4,511,325 4/1985 Voorheis .
4,815,966 3/1989 Jawssen ..... 431/115 X
4,988,287 1/1991 Stegelman et al. ..... 431/5 X
5,090,897 2/1992 Christenson .
5,257,927 11/1993 Lang ..... 431/354 X
5,275,552 1/1994 Schwartz et al. ..... 431/115 X
5,275,554 1/1994 Faulkner .
5,280,756 1/1994 Labbe .
5,310,337 5/1994 Lifshits et al. .
5,458,481 10/1995 Surberg et al. ..... 431/115

*Primary Examiner*—Larry Jones
*Attorney, Agent, or Firm*—Howson and Howson

[57] ABSTRACT

A flue gas recirculation burner providing reduced $No_x$ emissions uses a cylindrical tangential mixer to separately receive combustion air and flue gas through axial inlets. The mixed air and gas pass through a vaned diffuser which continues the tangential flow pattern, and thereafter fuel is introduced tangentially and combustion occurs.

16 Claims, 3 Drawing Sheets

FLUE GAS RECIRCULATION BURNER PROVIDING LOW $NO_X$ EMISSIONS

FIELD OF THE INVENTION

This invention relates to the field of burners for use with commercial and industrial boilers. In particular, it relates to a type of flue gas recirculation burner which greatly reduces air-polluting $No_x$ emissions.

BACKGROUND OF THE INVENTION

Flue gas recirculation (FGR) technology itself is not new. However, the present system is new, and it serves to reduce fuel $NO_x$ emissions far below those found on any commercial boiler.

Existing flue gas recirculation technologies recycle a portion of the relatively cool, low oxygen combustion products from the stack back into the burner. External piping is used to transport the flue gases and mix it with combustion air prior to burning, or, alternatively, to deliver it directly to the combustion zone. This recirculated flue gas acts as a diluent to lower the overall oxygen concentration, to lower the flame temperature, and to lower the residence time at peak temperature. These effects result in large reductions in thermal $No_x$ emissions, but a negligible reduction in fuel $No_x$ emissions. Therefore, flue gas recirculation achieves better reductions with gaseous fuels than with liquid fuels. Because of the greater potential for flame instability and emissions of unburned combustibles with distillate oil firing, recirculation rates are usually limited to approximately 10 to 15%; and, because of this lower recirculation rate and the presence of fuel $No_x$, oil-fired reductions are typically limited to only 20%.

Normally, one of two designs has been used to achieve FGR. In one, a separate powered fan was used to force the flue gases from the boiler stack into the air plenum or combustion chamber. In the other, the external FGR duct is so placed that the combustion air fan draws both combustion air and flue gases.

In the present invention, we improve the stability and performance limits of the burner by introducing the combustion air and the flue gas tangentially at high velocity into the burner blast tube. The two streams mix thoroughly and are then passed through a diffuser assembly where the air and FGR mixture is directed across natural gas nozzles located peripherally downstream of the diffuser. The combustion process takes place as a high velocity swirling flow down the length of the Morison tube (boiler furnace).

BRIEF SUMMARY OF THE INVENTION

Our combustion apparatus uses a combination of an intense, uniform fuel, air, and flue gas recirculation (FGR) mixing, a high angular momentum flame pattern, and a FGR system to produce low concentrations of $No_x$, CO, soot and UHC (unburned hydrocarbons) in the exhaust byproducts. FGR is provided through forced draft.

When firing gaseous fuels, a small quantity of burner exhaust gases (flue gas) is drawn from a heat exchanger vent stack by a separate FGR fan and forced through FGR piping to the front of the heat exchanger, by means of a FGR transition conduit, device, and into a cylindrical firing tube assembly, peripherally and on a tangent to the horizontal centerline of the firing tube. There, these exhaust gases are mixed with combustion air, which was provided by a combustion air fan, and separately and independently introduced into the air transition assembly, and into the firing tube upstream of the FGR transition conduit, also on a tangent to the horizontal centerline of the firing tube.

Having both the combustion air and FGR streams introduced tangentially and separately serves to impart a high swirl to the combustion air and FGR streams and thereby creates very uniform mixing of the streams by means of an intense fluid shearing action.

The combustion air and flue gas mixture swirls down the firing tube (tangential mixer) and into the gaseous fuel annulus (plenum), being mixed to uniformity. It then passes through a diffuser assembly which, in turn, increases the velocity and pressure of the mixture and intensifies swirl. The firing tube, diffuser assembly, have a common axis, preferably horizontal.

The gaseous fuel is also injected into the gas annulus by means of a tangential gas inlet pipe, and it likewise swirls within the gas annulus. The gas, combustion air, and flue gas are uniformly mixed by the shearing action; and combustion is then initiated inside a refractory-lined combustion chamber. The combustion chamber is circular in cross section, has an initial diameter approximating that of the diffuser, and has the same axis.

The high velocity swirling flow initiated by introducing the air and FGR streams tangentially produces some surprising results. The air and FGR streams are rapidly and completely blended, creating a homogenous fluid that very effectively mixes with the natural gas, resulting in clean, highly stable combustion.

DETAILED DESCRIPTION OF THE INVENTION

Figure 1:
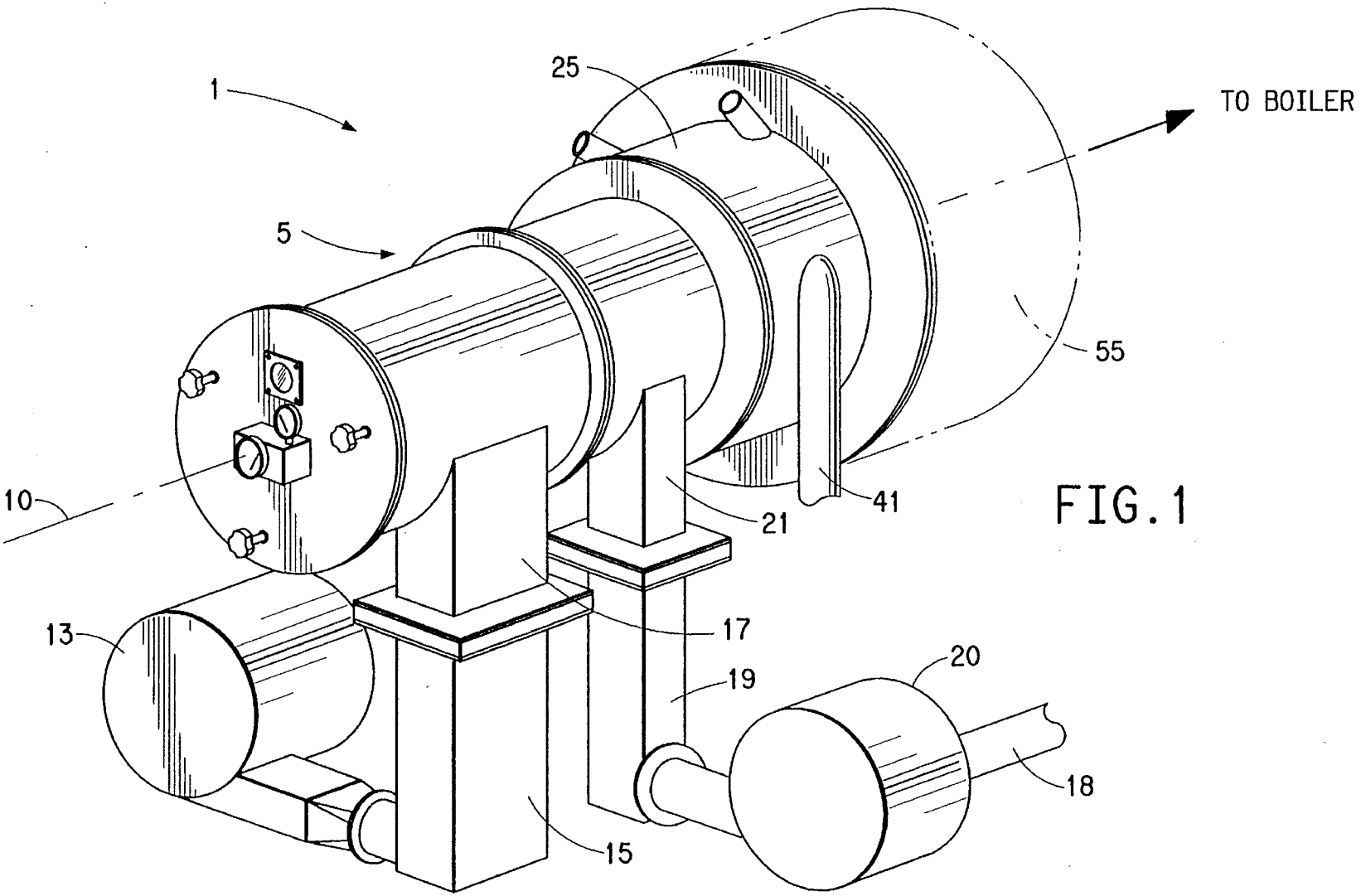
FIG. 1 is a perspective view of our burner.
Figure 2:
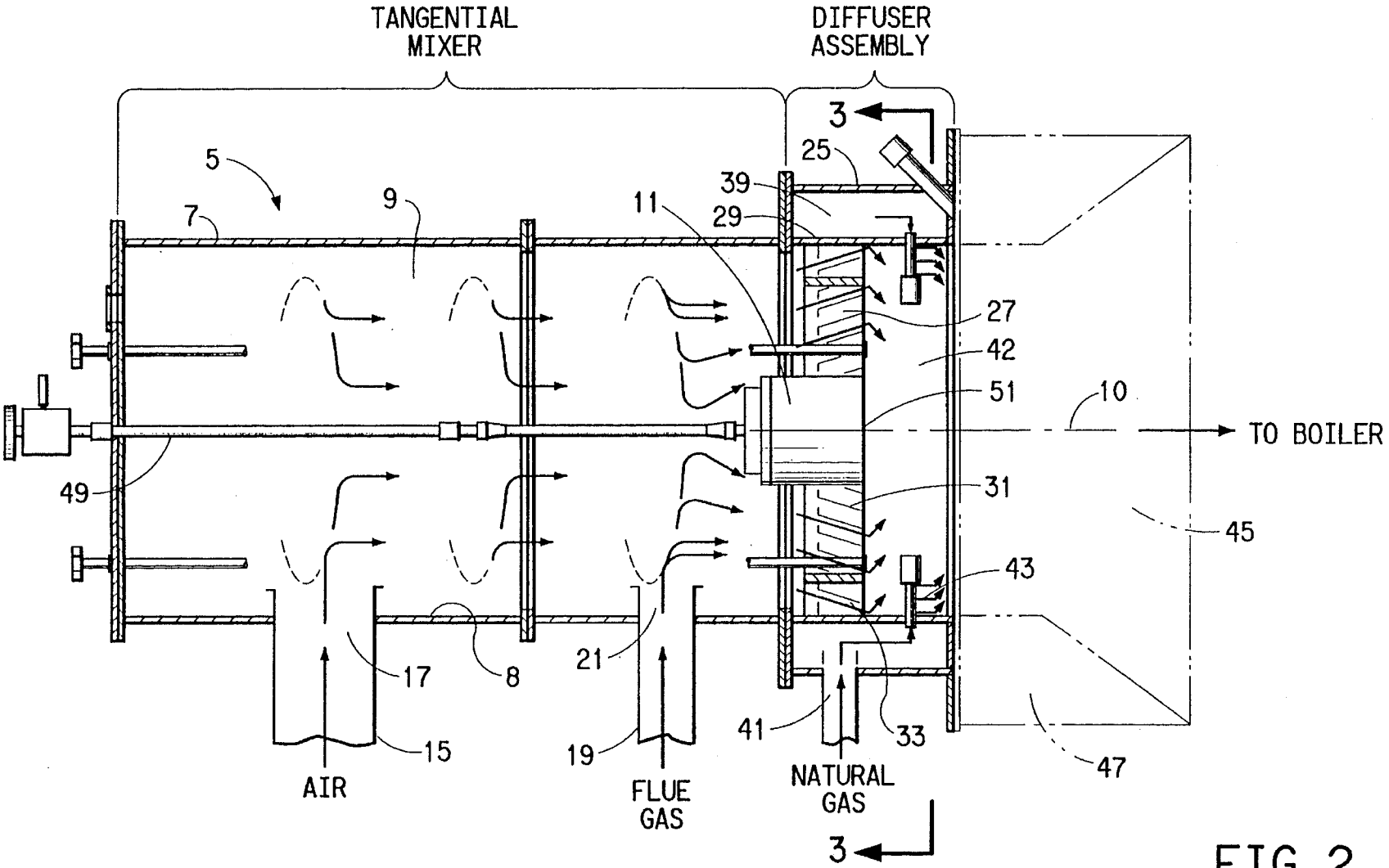
FIG. 2 is a vertical, longitudinal section of the burner of FIG. 1.
Figure 3:
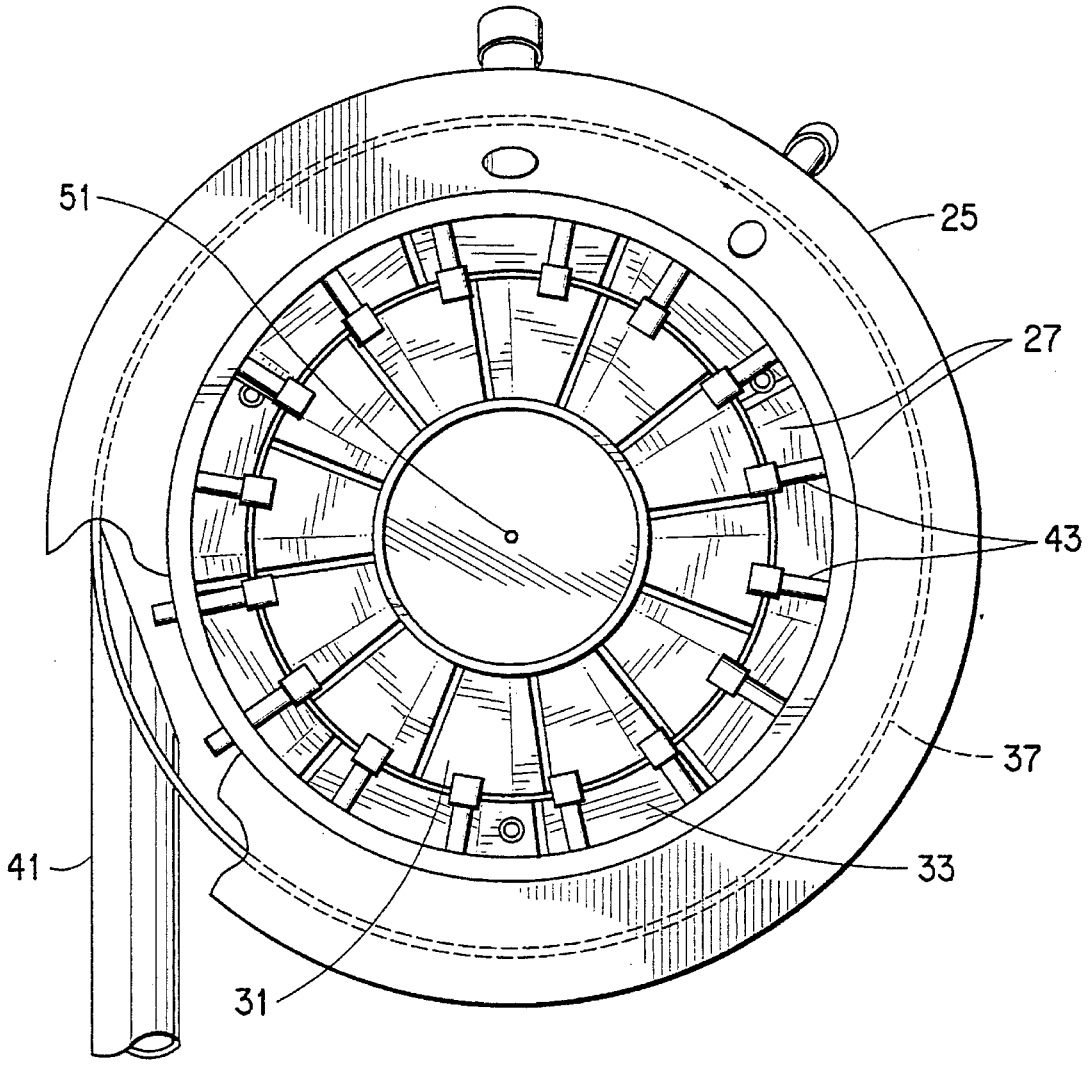
FIG. 3 transverse section, taken on line 3—3 of FIG. 2.

Our flue gas recirculation (FGR) burner includes, in series and running from upstream to downstream, a tangential mixer (firing tube) 5, a diffuser assembly 25, a gas head 42, and a combustion chamber 45. All have a common, straight horizontal axis 10, and circular cross-sections, preferably cylindrical. The burned gases from the combustion chamber then pass to the boiler.

Air to go into the mixer 5 is pressurized by air compressor 13 and passes through air conduit 15 to tangential air inlet 17. Flue gas for the mixer comes through flue gas return 18, through flue gas compressor 20 and then through flue gas conduit 19 to tangential flue gas inlet 20.

The tangential mixer 5 has circular walls 7 with inner surfaces 8, defining a cylindrical air plenum 9. Air and recirculated flue gas enter plenum 9 separately and tangentially, and pass through it to the air diffuser with a circular swirling motion, both rotating in the same direction. This swirl is caused by air being injected peripherally and tangentially into cylindrical plenum 9 through tangential air inlet 17, and by flue gas being subsequently injected peripherally and tangentially into cylindrical plenum 9 through tangential flue gas inlet 19. Preferably, the air is introduced into mixer 5 first, followed at a downstream point by the flue gas. Though this sequence can be reversed (by interchanging the positions of the air inlet 17 and the gas inlet 19), the air and gas should be introduced separately and independently, in different axial positions (different transverse planes) in the mixer 5. The direction of rotation of the air and gas should be the same. The resulting air and flue gas mixture passes into diffuser assembly 25, entering it primarily along the periphery of the assembly; it is prevented from entering through the axial, center portion by axial flow blocking plate 11.

Diffuser assembly 25 includes an inner cylinder 29 positioned with an air diffuser ring 27. The inner cylinder contains a plurality of stationary vanes, a set of inner air vanes 31 and a set of outer air vanes 33, the two sets being concentric with one another. These vanes are mounted at an angle which increases the rotation speed of the air/flue gas mixture passing through them, and which blocks axial flow. Thus, the vanes promote the tangential flow of the air and flue gas mix and enhance the mixing of the two. The mix, after leaving the vanes, enters cylindrical gas head 42.

An outer cylinder 37, surrounding inner cylinder 29, serves to form a natural gas plenum 39. Natural gas enters the gas plenum 39 through gas inlet 41 and leaves the plenum and enters the gas head 42 tangentially through a series of ports on gas nozzles 43 radially mounted proximate to the diffuser assembly. The gas leaves the nozzles in a tangential direction proximate to the inner surface of inner cylinder 29, and with a rotation direction the same as that of the air and flue gas mixture. Thus, the gas is admixed thoroughly with the swirling air and flue gas mixture. The tangential motion in both the tangential mixer 5 and in the gas head 42 results in a shearing action which enhances mixing. The resulting mixture passes into combustion chamber 45 (with refractory material 47 along its periphery), where it is burned. The resulting flame pattern has a high angular momentum. Combustion is completed within the refractory lined combustion chamber 45. The product of hot gases then passes to the Morison tube of the boiler in the usual manner.

It will be noted that the air and recirculated flue gas circulate together around the inner periphery of the tangential mixer before entering the diffuser assembly, to become thoroughly mixed. They then are further mixed as they pass through the diffuser assembly. This mixture is then mixed with the natural gas, resulting in a homogenous air-flue gas-natural gas mixture.

We have successfully operated the burner at oxygen levels <0.5% and >9% (which corresponds to excess air between 1% and almost 100%). As far as we know, there is no flue gas recirculation technology on the market which can approach this excess air operating range while maintaining stability. The system's excellent mixing also significantly reduces FGR consumption rates (by approximately 50%) to achieve a given level of $No_x$. We require only 8–10% FGR consumption (compared to about 15–20% for competitive burners) to reduce $No_x$ to 30 ppm. If we increase FGR rates to 15%, we can achieve $No_x$ levels of 20 ppm, a level of performance beyond the capabilities of most FGR burners. In addition, carbon monoxide rates are typically <10 ppm which is another indication of complete combustion.

The high velocity, swirling flow also improves the boiler performance, apparently due to scrubbing the walls of the Morison tube, which adds a significant convective component to the radiant heat transfer that normally occurs. It turns out that, at a given firing rate, the FGR burner combustion gases exiting the Morison tube are 200° F. cooler than conventional register burner baseline performance. In contrast to most FGR burners, which reduce efficiency compared to conventional burners, our burner improves boiler efficiency about 1.5% to 3%.

In order to provide for back-up, our burner can also operate on liquid fuel, such as fuel oil. In this instance, the fuel oil would enter through fuel oil line 49 and enter the gas head 42 through an atomizing fuel oil nozzle 51.

We have found that our invention has various unique features. Among them are:

1. Very low levels of $No_x$, CO, soot, and UHC are produced as a result of combustion.
2. The tangential alignment of the air and FGR inlets improves mixing, reduces noise and vibration, and reduces pressure drop.
3. Due to the intense fuel, air, and FGR mixing imparted by the apparatus, very low levels of excess air and FGR are required.
4. Due to the highly turbulent flame produced by this apparatus, which maintains uniform contact with heat exchange surfaces, and the ability to operate with very low levels of excess air and FGR, the thermal efficiency of the heat exchanger is increased.
5. The intense swirling flame created by the apparatus reduces noise and vibration of the combustion process.
6. The use of separate diffusers for gaseous and liquid fuel combustion prolongs equipment life and reduces maintenance requirements.

We claim:

1. A flue gas recirculation burner with reduced air-polluting emissions, said burner including a mixing tube having a circular cross-section, an inner surface, and a mixing tube axis, air inlet means formed in said mixing tube to receive air into said mixing tube and to cause said air to swirl peripherally along said inner surface in a rotary motion, flue gas inlet means formed in said mixing tube to receive flue gas into said mixing tube and to cause said flue gas to swirl peripherally along said inner surface in a rotary motion, the direction of rotation of said air and said flue gas being in the same direction for producing by fluid shear a uniform first mixture, a diffuser assembly connected to said mixing tube to receive said first mixture, said diffuser assembly having a circular cross-section coaxially aligned with said mixing tube axis for increasing the velocity and pressure of said first mixture, a cylindrical gas head connected to said diffuser assembly to receive said first mixture, said gas head having fuel means for introducing fuel into said first mixture for producing a homogeneous second mixture, and a combustion chamber connected to said diffuser assembly to receive said second mixture, said combustion chamber having a circular cross-section coaxially aligned with said mixing tube axis.

2. A flue gas recirculation burner as set forth in claim 1 in which said fuel means includes a plurality of nozzles radially mounted in said gas head proximate to said diffuser assembly positioned to direct gas into said gas head.

3. A flue gas recirculation burner as set forth in claim 2 including an outer cylinder concentrically mounted about said diffuser assembly defining a gas plenum communicating with said nozzles.

4. A flue gas recirculation burner as set forth in claim 2 in which said nozzles have outlet ports positioned for tangentially directing said fuel in the same direction as said first mixture.

5. A flue gas recirculation burner as set forth in claim 1 in which said fuel means includes a fuel oil atomizing nozzle positioned to direct fuel oil into said gas head.

6. A flue gas recirculation burner as set forth in claim 1 in which said diffuser assembly includes a plurality of stationary vanes.

7. A flue gas recirculation burner as set forth in claim 6 in which said stationary vanes are positioned at an angle to accelerate the rotation of said air and said flue gas.

8. A flue gas recirculation burner as set forth in claim 6 in which said stationary vanes form two concentric sets.

9. A flue gas recirculation burner as set forth in claim 1 in which said flue gas inlet means is positioned downstream of said air inlet means.

10. A flue gas recirculation burner as set forth in claim 1 in which air inlet means and said flue gas inlet means are mounted in positions separated from one another in the direction of said mixing tube axis.

11. A flue gas recirculation burner including, in series, a mixer, a diffuser, a gas head, and a combustion chamber, said mixer, said diffuser, said gas head, and said combustion chamber each having a circular cross section and having a common axis, an air inlet positioned to direct air under pressure tangentially into said mixer to cause a swirling motion of said air therein, a flue gas inlet positioned to direct flue gas under pressure tangentially into said mixer to cause a swirling motion of said flue gas therein, said diffuser being positioned to receive said air and said flue gas from said mixer, said diffuser having a plurality of vanes positioned at an angle for increasing the velocity and pressure of said air and said flue gas, said gas head being positioned to receive said air and said flue gas from said diffuser, fuel supply means in said gas head to add fuel to said air and said flue gas, and said combustion chamber being positioned to receive said air, said flue gas, and said fuel from said gas head and to maintain the swirling motion thereof.

12. A flue gas recirculation burner as set forth in claim 11 in which said mixer, said diffuser, and said gas head are each cylindrical.

13. A flue gas recirculation burner as set forth in claim 11 in which said common axis is horizontal.

14. A flue gas recirculation burner as set forth in claim 11 in which said fuel supply means includes a plurality of nozzles radially mounted in said gas head and positioned to direct fuel in the same tangential direction as said air and said flue gas.

15. A flue gas recirculation burner as set forth in claim 11 in which said flue gas inlet is spaced from said air inlet in the direction of said common axis.

16. A flue gas recirculation burner as set forth in claim 11 in which said flue gas inlet is position downstream from said air inlet.

* * * * *